US007864130B2

(12) United States Patent
Deng et al.

(10) Patent No.: US 7,864,130 B2
(45) **Date of Patent: *Jan. 4, 2011**

(54) BROADBAND SINGLE VERTICAL POLARIZED BASE STATION ANTENNA

(75) Inventors: Gang Yi Deng, Irvine, CA (US); John J. Dickson, Cypress, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 435 days.

This patent is subject to a terminal disclaimer.

(21) Appl. No.: 11/713,351

(22) Filed: Mar. 1, 2007

(65) Prior Publication Data

US 2007/0205952 A1 Sep. 6, 2007

Related U.S. Application Data

(60) Provisional application No. 60/779,241, filed on Mar. 3, 2006.

(51) Int. Cl.
*H01Q 9/28* (2006.01)

(52) U.S. Cl. ..... 343/795

(58) Field of Classification Search ..... 343/795, 343/797, 872, 702, 853
See application file for complete search history.

(56) References Cited

U.S. PATENT DOCUMENTS

| | | | | |
|---|---|---|---|---|
| 5,274,391 | A | 12/1993 | Connolly | |
| 5,572,222 | A | 11/1996 | Mailandt et al. | |
| 5,949,303 | A | 9/1999 | Arvidsson et al. | |
| 5,969,689 | A | 10/1999 | Martek et al. | |
| 6,034,649 | A | 3/2000 | Wilson et al. | |
| 6,285,336 | B1 | 9/2001 | Zimmerman | |
| 6,515,633 | B2 * | 2/2003 | Ippolito | 343/797 |
| 6,529,172 | B2 | 3/2003 | Zimmerman | |
| 6,567,055 | B1 | 5/2003 | Oglesby | |
| 6,697,029 | B2 * | 2/2004 | Teillet et al. | 343/797 |
| 6,717,555 | B2 * | 4/2004 | Teillet et al. | 343/797 |
| 6,747,606 | B2 * | 6/2004 | Harel et al. | 343/808 |
| 6,756,939 | B2 | 6/2004 | Chen et al. | |
| 6,809,694 | B2 | 10/2004 | Webb et al. | |
| 6,822,618 | B2 | 11/2004 | Bisiules et al. | |
| 6,864,837 | B2 | 3/2005 | Runyon et al. | |
| 6,922,169 | B2 | 7/2005 | Izzat et al. | |

(Continued)

FOREIGN PATENT DOCUMENTS

| | | |
|---|---|---|
| EP | 0566522 | 10/1993 |

(Continued)

OTHER PUBLICATIONS

Supplemental European Search Report pertaining to European Patent Application No. 07751869.4/PCT/2007005137 mailed Feb. 4, 2010.

(Continued)

*Primary Examiner*—Huedung Mancuso
(74) *Attorney, Agent, or Firm*—OC Patent Law Group

(57) ABSTRACT

An antenna for receiving and/or transmitting electromagnetic signals is disclosed. The antenna includes a ground plane with a length and having a vertical axis along the length, and a dipole radiating element projects outwardly from a surface of the ground plane. The radiating element includes a feed section, and a ground section.

25 Claims, 9 Drawing Sheets

U.S. PATENT DOCUMENTS

| | | | | |
|---|---|---|---|---|
| 6,924,776 | B2 * | 8/2005 | Le et al. | 343/792.5 |
| 6,933,905 | B2 * | 8/2005 | Ippolito | 343/797 |
| 6,950,061 | B2 | 9/2005 | Howell et al. | |
| 7,006,053 | B2 | 2/2006 | Zigler et al. | |
| 7,075,497 | B2 * | 7/2006 | Teillet et al. | 343/797 |
| 7,358,922 | B2 * | 4/2008 | Le et al. | 343/797 |
| 7,405,710 | B2 * | 7/2008 | Bisiules et al. | 343/797 |
| 7,710,344 | B2 | 5/2010 | Deng et al. | |
| 2002/0149529 | A1 | 10/2002 | Fleming et al. | |
| 2005/0219140 | A1 | 10/2005 | Browne et al. | |
| 2005/0231437 | A1 | 10/2005 | Dai et al. | |
| 2007/0146222 | A1 | 6/2007 | Mansour | |
| 2007/0241979 | A1 | 10/2007 | Yang | |
| 2009/0015498 | A1 | 1/2009 | Deng et al. | |

FOREIGN PATENT DOCUMENTS

| | | |
|---|---|---|
| EP | 1098391 | 5/2001 |
| EP | 1950832 | 7/2008 |
| WO | 2005/060045 | 6/2005 |

OTHER PUBLICATIONS

International Search Authority, Written Opinion for International Application No. PCT/US 08/02845 dated Jun. 2, 2008, 7 pages.
International Search Authority, Written Opinion for International Application No. PCT/US 08/03176 dated Jun. 11, 2008, 8 pages.

* cited by examiner

BROADBAND SINGLE VERTICAL POLARIZED BASE STATION ANTENNA

RELATED APPLICATION

This application claims the benefit under 35 U.S.C. 119 (e) of U.S. provisional patent application Ser. No. 60/779,241, filed on Mar. 3, 2006, incorporated herein by reference in its entirety.

FIELD OF THE INVENTION

The present invention relates to broadband base station antennas for wireless communications systems.

BACKGROUND OF THE INVENTION

The number of base station antennas needed for cellular and other wireless communications applications is increasing rapidly due to increased use of mobile wireless communications. Therefore, it is desirable to design low cost base station antennas. At the same time such wireless applications increasingly will require wideband capability. Most of the previous approaches to such antenna designs are dipole antennas with fish hook type of balun feed with various arrangements. Such systems are not readily compatible with the desired goals of low cost and wide bandwidth. Accordingly, a need presently exists for an improved base station antenna design.

BRIEF SUMMARY OF THE INVENTION

The present invention provides a broadband single vertical polarized base station antenna and assembly that addresses the above shortcomings. In one embodiment, the present invention provides an antenna assembly for receiving and/or transmitting electromagnetic signals, comprising a ground plane and at least one dipole antenna, wherein each dipole antenna includes a first conductor extending transversely from a surface of the ground plane, the first conductor having a first radiating element projecting outwardly therefrom; and a second conductor coupled to the ground plane by a dielectric and extending transversely relative to the surface of the ground plane spaced from the first conductor, the second conductor having a second radiating element projecting outwardly therefrom. Further, the first and second conductors are spaced from one another by a gap, and the first and second radiating elements project outwardly in essentially opposite directions.

In another embodiment, the present invention provides a broadband single vertical polarized base station comprising a ground plane and an antenna assembly including multiple dipole antennas. Each dipole antenna, comprises a first conductor extending transversely from a surface of the ground plane, the first conductor having a first radiating element projecting outwardly therefrom; and a second conductor coupled to the ground plane by a dielectric and extending transversely relative to the surface of the ground plane spaced from the first conductor, the second conductor having a second radiating element projecting outwardly therefrom. Further, the first and second conductors are spaced from one another by a gap, and the first and second radiating elements project outwardly in essentially opposite directions. A feed line is coupled to said first conductor of each dipole antenna and spaced from said ground plane by an air dielectric, wherein the feed line provides a common input to the dipole antennas.

In another embodiment, the present invention provides an antenna for receiving and/or transmitting electromagnetic signals, comprising a ground plane with a length and having a vertical axial along the length, and a dipole radiating element projects outwardly from a surface of the ground plane. The radiating element includes a feed section and a ground section.

Further features and advantages of the present invention are set out in the following detailed disclosure.

DETAILED DESCRIPTION OF THE INVENTION

The present invention provides an antenna for use in wireless communication systems which addresses the above noted problems. One embodiment of the present invention operates across various frequency bands, 806-960 MHz band, 380-470 MHz band, 1710-2170 MHz. Although the present invention is particularly adapted for use in a base station, it also can be used in all types of telecommunication systems, such as WiMax 2.3 GHz, 2.5 GHz and 3.5 GHz bands, etc.

Figure 1:
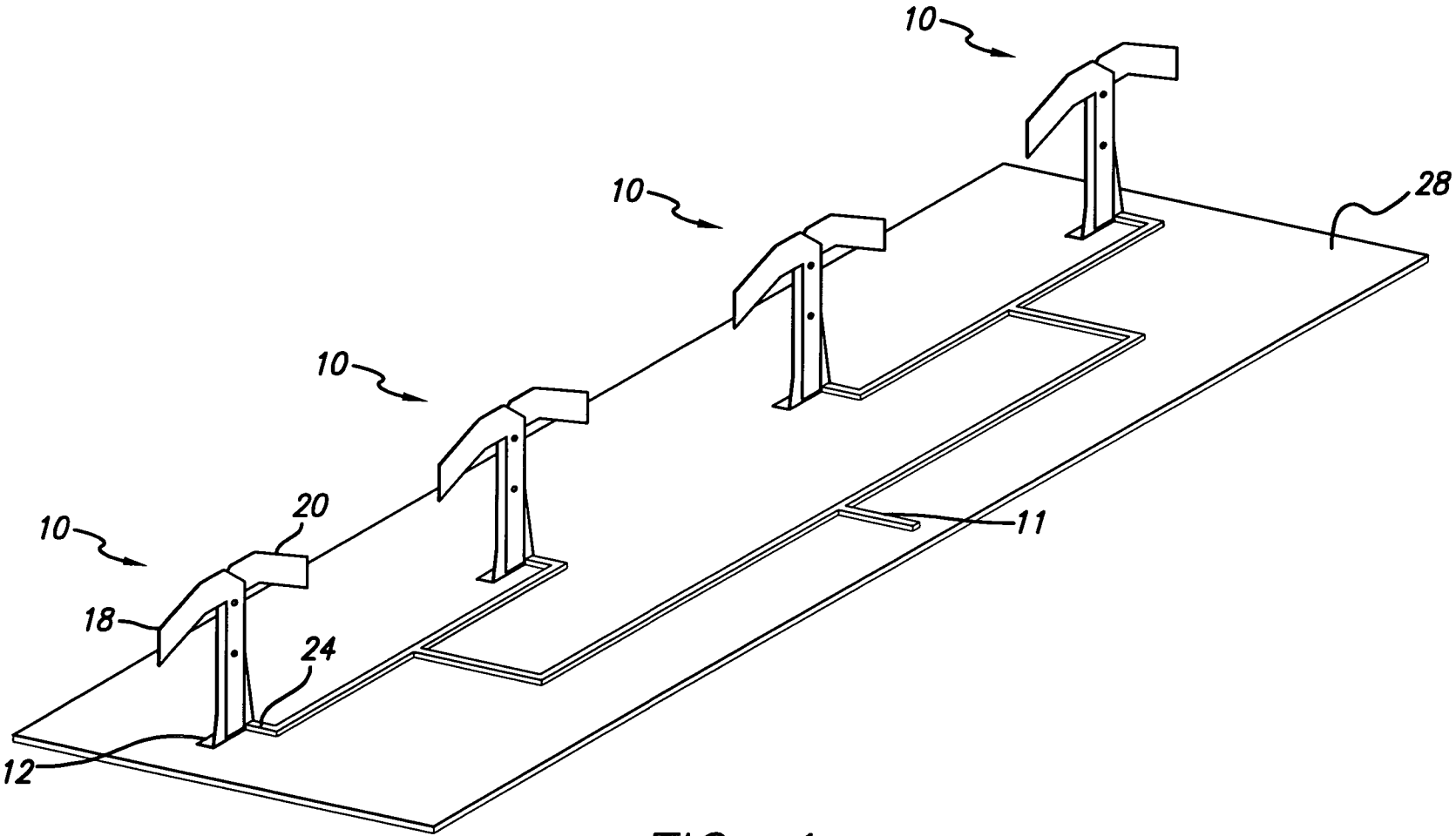
FIG. 1 shows a vertical polarized base station antenna on a ground plane, according to an embodiment of the present invention.
Figure 5:
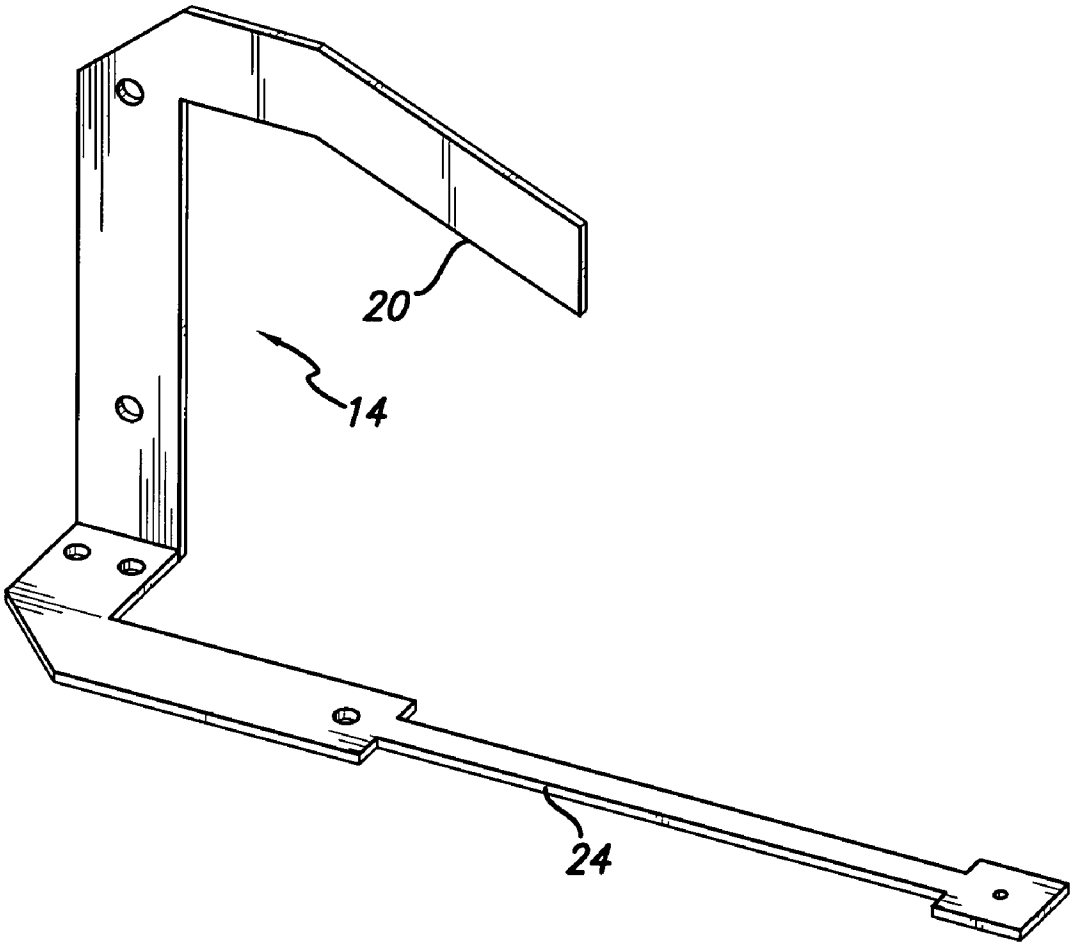
FIG. 5 shows one of the dipole arm with the microstrip line attached, according to an embodiment of the present invention
Figure 6:
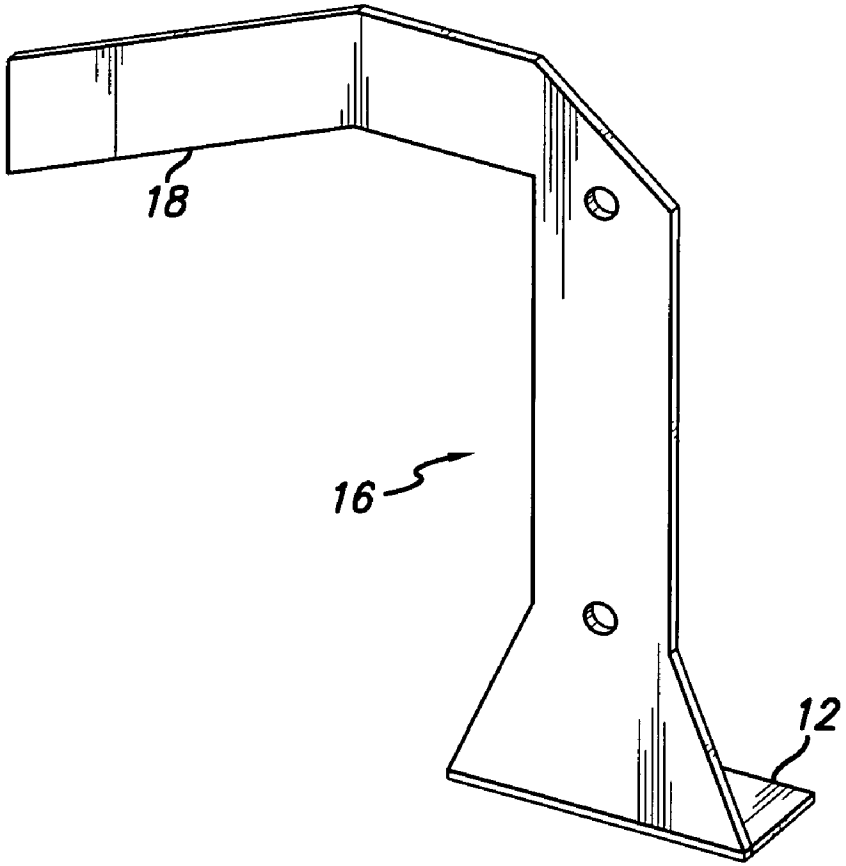
FIG. 6 shows one of the dipole arm attached to the ground plane, according to an embodiment of the present invention.

FIG. 1 shows a set of four example dipole array antennas 10 with a common input 11, according to the present invention, for transmitting and receiving electromagnetic signals. Each antenna element 10 (FIG. 7) includes two arms 18, 20, a ground plate 12 and two electrical conductors/legs 14 and 16 (FIGS. 5 and 6). The conductor 16 is attached to ground using the plate 12, with a dipole arm 18 (FIG. 6) towards one side, while the other conductor 14 is spaced to the ground by a dielectric 23 (FIG. 3B), such as air, foam, etc., with a dipole arm 20 (FIG. 5) towards the opposite side of dipole arm 20, therefore forming a dipole configuration. Each dipole arm forms a radiating section/element. In this example, the conductor 14 and dipole arm 20 are formed/stamped from a sheet of conductive material, forming an L-shape. Further, the conductor 16 and dipole arm 18 are formed/stamped from a sheet of conductive material, forming an L-shape. The input conductors 14 and 16 are separated by a gap 22 (FIGS. 3B, 8A-C).

The conductor 14 connects a part of the dipole arm 20 to a feed line 24 and the conductor 16 connects a part of the dipole arm 18 to ground via the plate 12.

The conductors 14 and 16 form a paired strips transmission line having an impedance. The arms 18, 20 also have an impedance.

The impedance of the paired strips transmission line 14, 16, is adjusted by varying the width of conductor sections 14, 16 and/or the gap 22 therebetween. The specific dimensions vary with the application. As such, the intrinsic input impedance of each dipole is adjusted to match the impedance of the corresponding feed section.

The two conductor sections 14, 16 of the dipole antenna form a balanced paired strips transmission line; therefore, it is unnecessary to provide a balun. This provides the antenna 10 with a very wide impedance bandwidth. Also, the antenna 10 has a stable far-field pattern across the impedance bandwidth.

Figure 4:
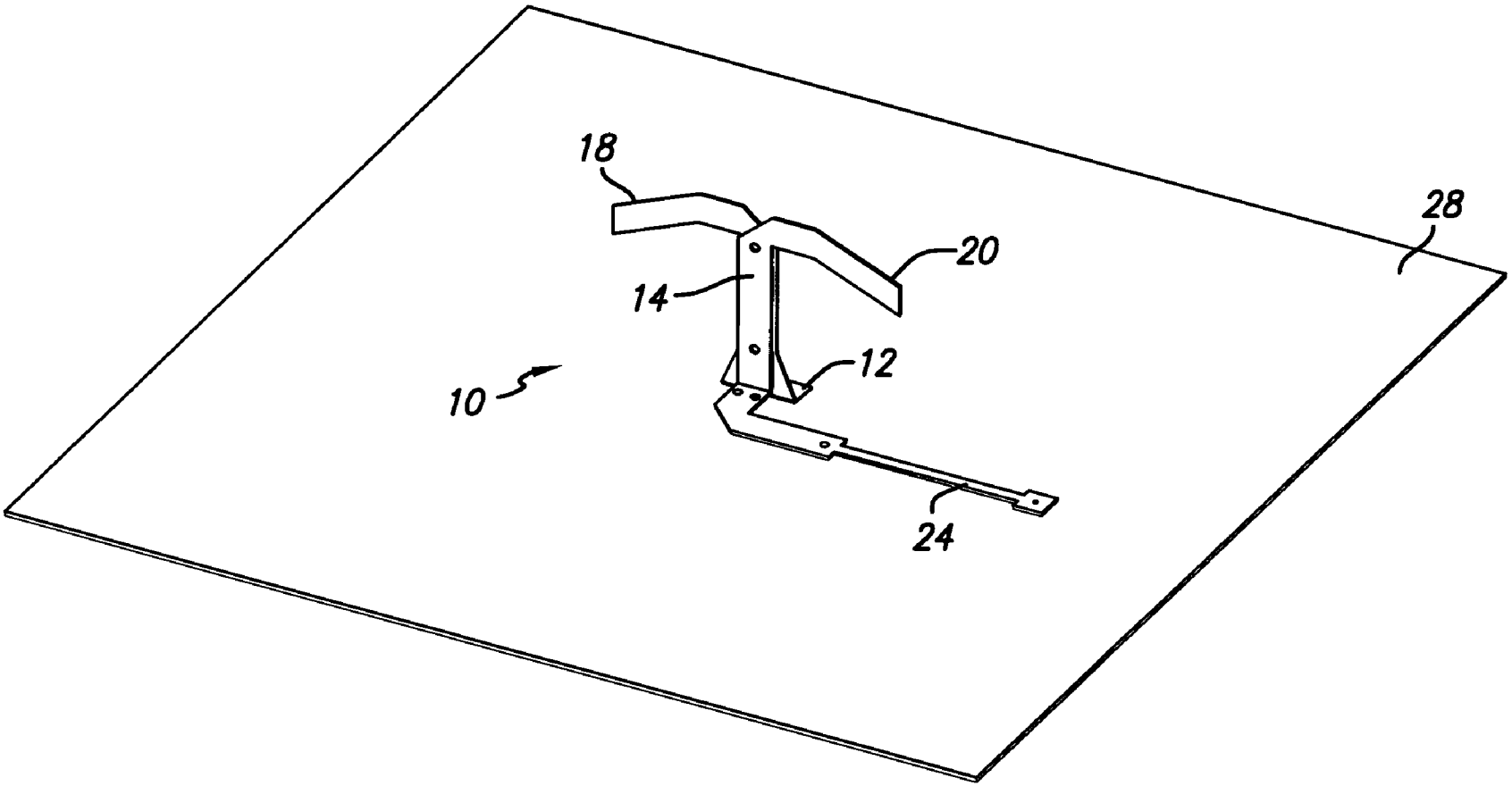
FIG. 4 shows an isometric view of a dipole antenna on the ground plane, according to an embodiment of the present invention.
Figure 7:
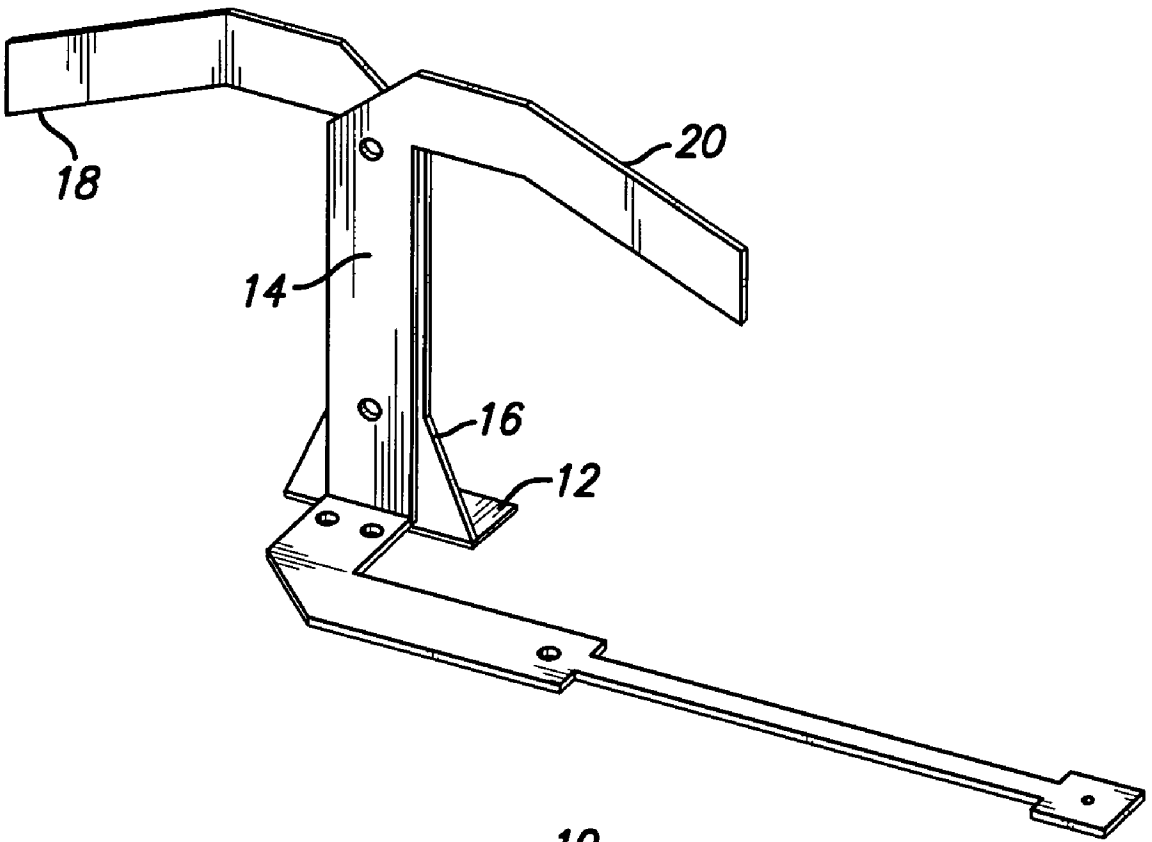
FIG. 7 shows an isometric view of the dipole antenna without the ground plane, according to an embodiment of the present invention.

FIG. 4 shows an isometric view of a single dipole antenna 10 on the ground plane 28. FIG. 5 shows the dipole arm 20 with the microstrip feed line 24 attached and FIG. 6 shows the dipole arm 18 that can be attached to the ground plane 28 via the plate 12. The feed line 24 (and its extension feed line 11) comprises a microstrip feed line spaced from the ground plane 28 by non-conductor such as air dielectric (e.g., dielectric 23). The impedance of the microstrip line is adjusted by varying the width of the element 24, and/or the space between the microstrip line to the ground plane. The feed line 24 is shown as a unitary element of the conductor 14. FIG. 7 shows an isometric view of the dipole antenna 10, as combination of elements in FIGS. 5 and 6.

The conductor section 16 can be connected to the ground plane 28 by any suitable fastening device 30 (FIG. 3B) such as a nut and bolt, a screw, a rivet, or any suitable fastening method including soldering, welding, etc. The suitable connection provides both an electrical and mechanical connection between the conductor 16 and ground plane 28.

Figure 2:
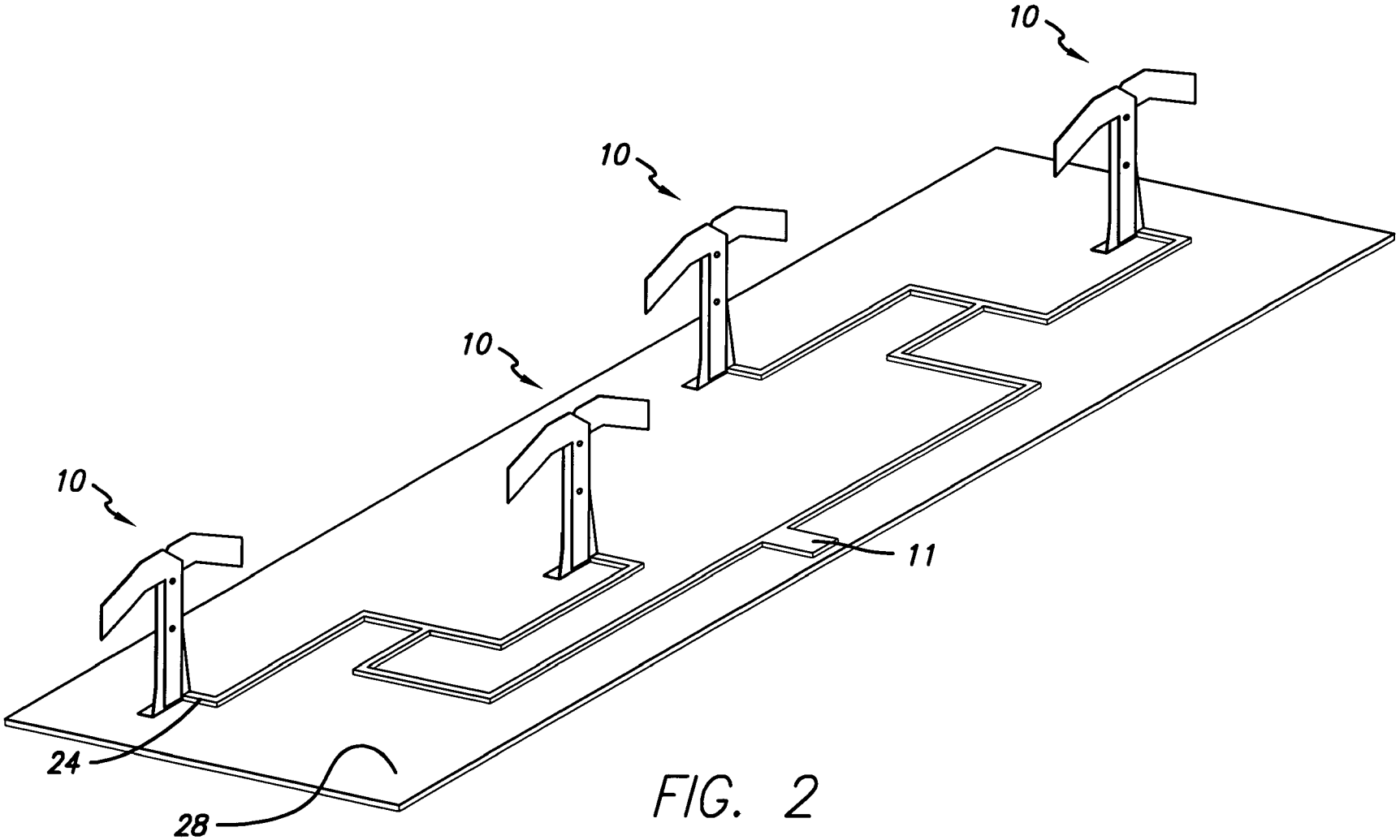
FIG. 2 shows a staggered dipole antenna arrangement on the ground plane, according to an embodiment of the present invention.
Figure 3A:
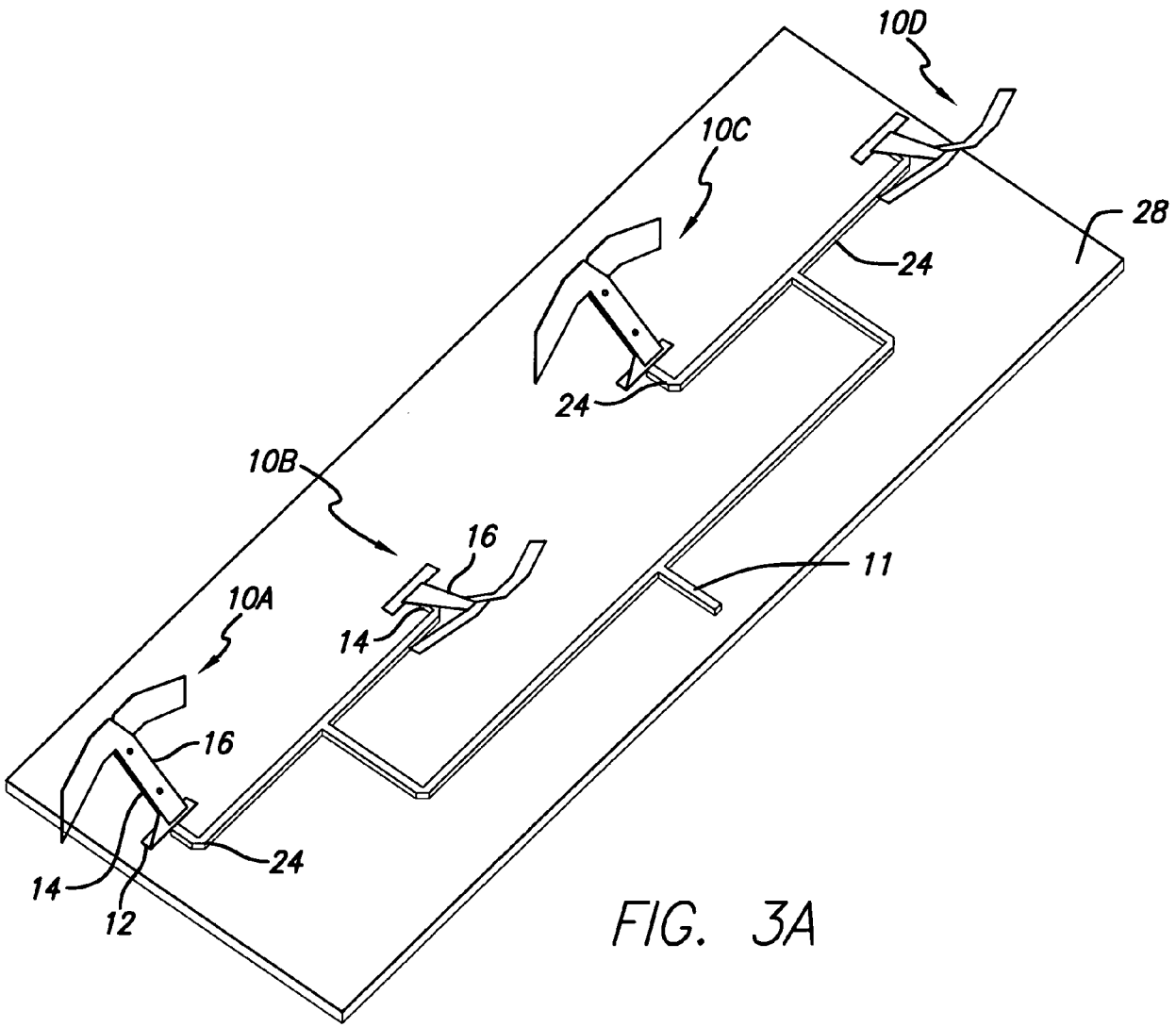
FIG. 3A shows another staggered dipole antenna arrangement on the ground plane, according to an embodiment of the present invention.
Figure 3B:
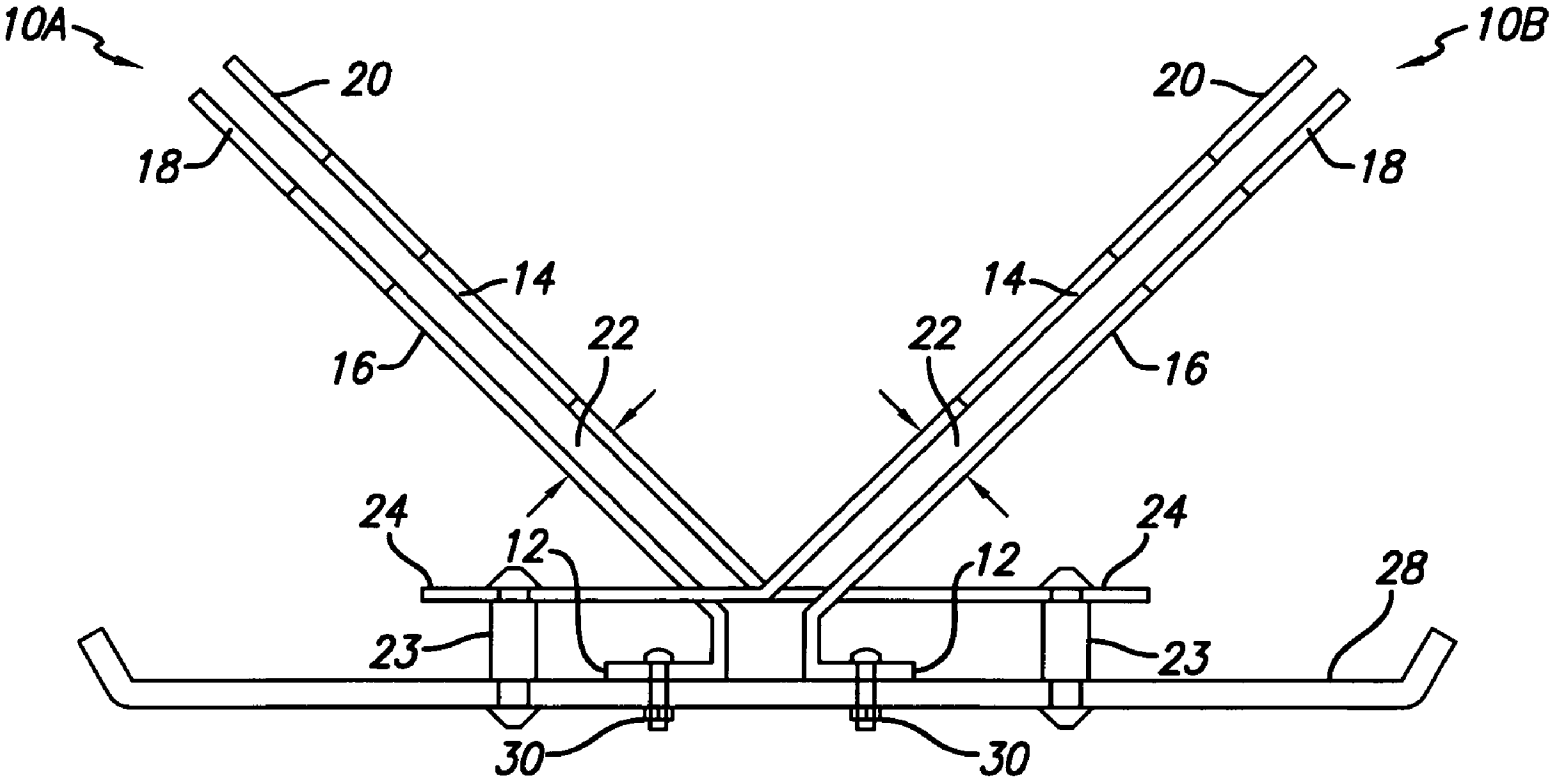
FIG. 3B shows the end view of the staggered dipole arrangement of FIG. 3A, according to an embodiment of the present invention.

The arrangement of the four dipole antennas 10 in FIG. 1 provides 90 degree, 105 degree, and 120 degree 3 dB azimuth beam width base station antenna implementations, with different shapes of the ground plane 28. The staggered dipole arrangement in FIG. 2 and FIGS. 3A-B provide a 65 degree 3 dB azimuth beam width base station antenna implementations. In the staggered arrangement in FIG. 2 the legs 14, 16 of the antennas 10 are essentially perpendicular to the ground plane 28.

In the above implementation, the legs 14, 16 of each antenna 10 are at about 90 degree angles in relation to the ground plane 28. In another implementation, the legs 14, 16 of an antenna 10 can be at less than 90 degree angles to the ground plane 28. For example, the legs 14, 16 of an antenna 10 can be between about 90 degrees (perpendicular to the ground plane 28) and about 30 degree to the ground plane 28. Other angles are possible. FIGS. 3A-B provide examples of a staggered arrangement with the legs 14, 16 of each antenna between about 90 degrees (perpendicular to the ground plane 28) and about 30 degree to the ground plane 28.

FIG. 3A shows a staggered arrangement of four dipole antennas 10A-D on the ground plane 28, wherein the legs 14, 16 of each the antenna 10A are transverse in relation to the legs 14, 16 of the antenna 10B. Further, the legs 14, 16 of the antenna 10A are at less than 90 degree angles (e.g., 30 to 90 degrees) in relation to the ground plane 28. Similarly, the legs 14, 16 of the antenna 10B are at less than 90 degree angles (e.g., 30 to 90 degrees) in relation to the ground plane 28. As such, in this example the dipole antennas 10A and 10B can be at transverse angles of e.g. greater than 0 to about 120 degrees, in relation to one another. Other transverse angles between the antennas 10A and 10B are possible.

Similarly the legs of the antennas 10C and 10D are transverse in relation to one another, and at less than 90 degrees in relation to the ground plane 28. FIG. 3B shows a partial end view of the staggered dipole arrangement of FIG. 3A, showing antennas 10A and 10B.

Figures 8A, 8B, 8C:
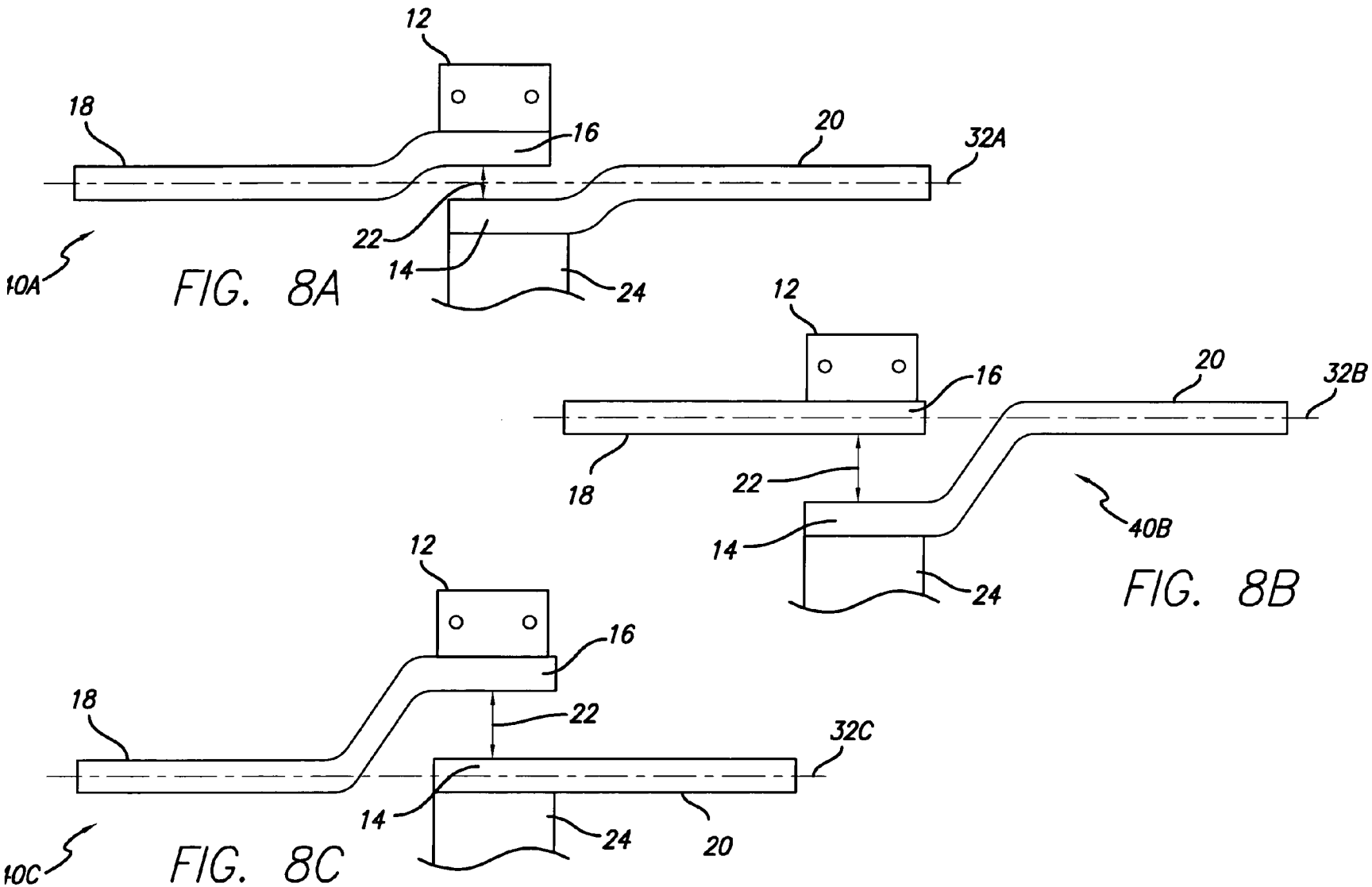
FIGS. 8A-C shows top views of alternate dipole arm arrangements, according to the present invention.

Specific additional variations and implementation details will vary with the particular application as will be appreciated by those skilled in the art. For example, FIGS. 8A-C show top views of alternate dipole arm arrangements, according to the present invention. The gap 22 between the legs 14 and 16 in the alternate antennas 40A-C in FIGS. 8A-C is the same, while FIGS. 8B and 8C show an enlarged view of the gap 22 for clarity.

FIG. 8A shows a top view of the antenna 40A wherein the dipole arms 18, 20 and the legs 14, 16 are symmetric. Further, the legs 14 and 16 are the same distance from the centerline 32A of the dipole arms 18, 20. FIG. 8B shows a top view of the antenna 40B wherein the dipole arms 18, 20 are asymmetric, and the leg 16 lies on the centerline 32B of the dipole arms 18, 20. FIG. 8C shows a top view of the antenna 40C wherein the dipole arms 18, 20 are asymmetric, and the leg 14 lies on the centerline 32C of the dipole arms 18, 20.

Further features and advantages of the invention will be apparent to those skilled in the art. Also, it will be appreciated by those skilled in the art that a variety of modifications of the illustrated implementation are possible while remaining within the scope of the invention.

What is claimed is:

1. An antenna assembly for receiving and/or transmitting electromagnetic signals, comprising:

a ground plane;

at least one pair of dipole antennas, each dipole antenna including:

a first conductor extending transversely from a surface of the ground plane at an angle less than 90 degrees and electrically connected to the ground plane, the first conductor comprising a first radiating element projecting outwardly therefrom;

a second conductor spaced from the ground plane by a dielectric and extending transversely relative to the surface of the ground plane at an angle less than 90 degrees and substantially the same orientation of the first conductor, the second conductor comprising a second radiating element projecting outwardly therefrom;

wherein the first and second conductors are spaced from one another by a gap, and the first and second radiating elements project outwardly in essentially opposite directions; and wherein the first and second conductors of the dipole antennas of each pair are oriented in different directions relative to the ground plane.

2. The antenna assembly of claim 1 further comprising a microstrip feed line coupled to said first conductor, and spaced from said ground plane by an air dielectric.

3. The antenna assembly of claim 1 wherein the first and second radiating elements are essentially in the same plane.

4. The antenna assembly of claim 1 wherein the first conductor and the first radiating element are formed from a sheet of conductive material.

5. The antenna assembly of claim 1 wherein the first conductor and the first radiating element form an essentially L-shape.

6. The antenna assembly of claim 1 wherein the second conductor and the second radiating element are formed from a sheet of conductive material.

7. The antenna assembly of claim 1 wherein the second conductor and the second radiating element form an essentially L-shape.

8. The antenna assembly of claim 1 wherein the first and second conductors are spaced in essentially parallel relationship, forming a balanced paired strips transmission line.

9. The antenna assembly of claim 2 wherein each radiating element has an intrinsic input impedance that is adjusted to match the impedance of the microstrip line.

10. The antenna assembly of claim 9 wherein the impedance of the microstrip line is adjusted by adjusting the width of the microstrip line and/or the space between the microstrip line and ground plane.

11. The antenna assembly of claim 8 wherein the impedance of the paired strips transmission line is adjusted by adjusting the width of the conductor and/or gap between the conductors.

12. The antenna assembly of claim 1 wherein said at least one dipole antenna comprises an array of plural dipole antennas having a common feed line coupled to each dipole antenna.

13. The antenna assembly of claim 12 wherein the dipole antennas are arranged in a row.

14. The antenna assembly of claim 13 wherein said array of dipole antennas comprises four dipole antennas arranged in a row providing 90 degree, 105 degree, and 120 degree 3 dB azimuth beams.

15. The antenna assembly of claim 12 wherein the plural dipole antennas are arranged in a staggered pattern.

16. The antenna assembly of claim 15 comprising at least a pair of dipole antenna arranged in a staggered pattern.

17. The antenna assembly of claim 16 comprising plural pairs of staggered dipole antennas.

18. The antenna assembly of claim 17 wherein each pair of staggered dipole antennas provides a 65 degree 3 dB azimuth beam.

19. The antenna assembly of claim 16 wherein the dipole antennas are at transverse angles greater than zero and less than 120 degrees in relation to one another.

20. A broadband single vertical polarized base station comprising:

a ground section including a ground plane;

an antenna assembly section comprising plural dipole antennas, wherein each dipole antenna, comprises:

a first conductor extending transversely from a surface of the ground plane at an angle less than 90 degrees and electrically coupled to the ground plane, the first conductor having a first radiating element projecting outwardly therefrom; and a second conductor spaced from the ground plane by a dielectric and extending transversely relative to the surface of the ground plane spaced from the first conductor, the second conductor having a second radiating element projecting outwardly therefrom;

wherein the first and second conductors are spaced from one another by a gap, and the first and second radiating elements project outwardly in essentially opposite directions;

wherein the first and second conductors are spaced in essentially parallel relationship, forming a balanced paired strips transmission line; and wherein the plural antennas are configured in pairs and wherein the first and second conductors of the dipole antennas of each pair are oriented in different directions relative to the ground plane; and a feed section comprising a microstrip feed line coupled to said second conductor of each dipole antenna and spaced from said ground plane by an air dielectric, wherein the microstrip feed line provides a common input to the dipole antennas.

21. The antenna of claim 20 wherein the radiating element includes a feed section and a ground section.

22. The antenna of claim 20 wherein the antenna is configured to operate in the 806 to 960 MHz frequency band.

23. The antenna of claim 20 wherein the antenna is configured to operate in the 380 to 470 MHz frequency band.

24. The antenna of claim 20 wherein the antenna is configured to operate in the 1710 to 2170 MHz frequency band.

25. The antenna of claim 20 wherein the antenna is configured to operate in one or more of 380 to 470 MHz, 806 to 960 MHz, and 1710 to 2170 MHz frequency bands.

* * * * *